United States Patent [19]

Vallaude

[11] 4,372,194

[45] Feb. 8, 1983

[54] INTERNAL COMBUSTION ENGINE PISTON

[75] Inventor: Jean P. Vallaude, Orsay, France

[73] Assignee: Regie Nationale Des Usines Renault, Boulogne-Billancourt, France

[21] Appl. No.: 177,769

[22] PCT Filed: Mar. 30, 1979

[86] PCT No.: PCT/FR79/00029

§ 371 Date: Nov. 30, 1979

§ 102(e) Date: Nov. 30, 1979

[87] PCT Pub. No.: WO79/00862

PCT Pub. Date: Nov. 1, 1979

[30] Foreign Application Priority Data

Mar. 31, 1978 [FR] France ..... 78 09460

[51] Int. Cl.[3] ..... F01P 1/04; F02F 3/16

[52] U.S. Cl. ..... 92/176; 92/221; 92/224; 123/193 P

[58] Field of Search ..... 92/176, 186, 224, 220, 92/221; 123/193 P, 41.16, 41.35

[56] References Cited

U.S. PATENT DOCUMENTS

| | | | |
|---|---|---|---|
| 1,547,737 | 7/1925 | Daiber | 92/176 X |
| 2,198,771 | 4/1940 | Hazen et al. | 92/176 |
| 2,214,891 | 9/1940 | Schrom | 92/176 X |
| 2,743,143 | 4/1956 | Maybach | 92/221 |
| 3,385,175 | 5/1968 | Meier et al. | 92/176 |

FOREIGN PATENT DOCUMENTS

| | | | |
|---|---|---|---|
| 733442 | 3/1943 | Fed. Rep. of Germany | 92/176 |
| 707660 | 4/1931 | France | 92/221 |
| 912393 | 4/1946 | France | 92/176 |
| 2155751 | 5/1973 | France . | |
| 365075 | 1/1932 | United Kingdom | 92/221 |
| 487377 | 6/1938 | United Kingdom | 123/41.35 |
| 1117610 | 6/1968 | United Kingdom . | |

*Primary Examiner*—Irwin C. Cohen

*Attorney, Agent, or Firm*—Oblon, Fisher, Spivak, McClelland & Maier

[57] ABSTRACT

Internal combustion engine piston of the composite type, having a steel upper portion surmounting an aluminum lower portion in which the piston ring grooves are provided.

The lower portion (2) comprises a concentric circular cavity (3), open at the top and recessed from the ring grooves (5), said cavity being covered by an annular groove (7) in the lower surface of the steel upper portion (1) to form a dead space.

3 Claims, 1 Drawing Figure

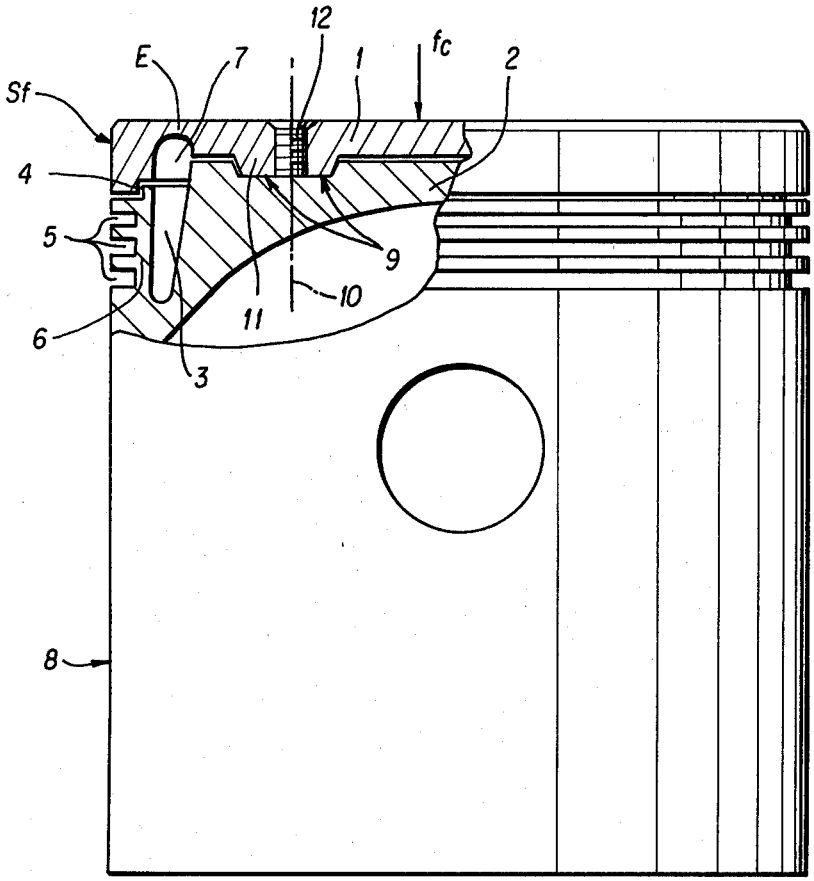
12
E
7
1
fc
2
Sf
4
5
9
10
11
6
3
8

INTERNAL COMBUSTION ENGINE PISTON

BACKGROUND OF THE INVENTION

1. Field of the Invention

The present invention, relates to a piston construction for internal combustion engines, particularly for engines which operate at high temperatures and pressures such as Diesel engines.

2. Description of the Prior Art

In such engines, the piston surfaces exposed to the force of the explosion must hold up to said explosion and remain, as soon as possible after starting, at said high operating temperatures and pressures. In contrast, the ring area, and particularly the so-called firing ring, must be protected from the effects of high temperature gas explosions in order to avoid rapid carbon depositing.

A known solution to these problems is to construct composite pistons, of which the upper, steel portion faces the explosion and is maintained at a higher temperature than a lower portion of a light alloy holding the rings and having a classic piston shape, in which the steel upper portion is set, either by assembly or in the form of an insert onto which the lower, light alloy portion is directly cast.

SUMMARY OF THE INVENTION

The object of the present invention is a composite piston of this type, comprising an upper steel surface set onto a lower portion of a light alloy by means of a screw assembly itself known, characterized in that said lower portion comprises a circular cavity, open at the top, concentrically recessed and in proximity to the ring groove beds, said cavity being covered by the steel upper portion.

Said upper portion is advantageously centered on—without contacting—a ledge above the firing ring provided on the upper border of the neck containing the ring grooves and delimiting the aforementioned cavity. Said upper portion advantageously comprises on its lower surface a circular groove covering the circular cavity and forming, within the upper portion, a zone of reduced thickness above said cavity and surrounding the central portion of the piston, which latter may contain, within the steel portion, bossings and threaded assembly holes in said bossings, with corresponding cavities, bossings and screw passage holes in the light alloy lower portion. The contact surfaces of the two assembled portions, in the central portion of the piston, are reduced to the minimum consistent with the mechanical reliability of the light alloy portion.

It follows from this construction that the steel upper portion of the piston, and particularly its central portion, is relatively isolated from the rest of the structure, with a minimum of contact surface. Moreover, the reduced thickness above the circular cavity limits calorific diffusion from center to periphery, and said periphery is only connected to the ring area by the low contact surface on the centering ledge which is itself recessed from the upper surface of the piston, of which the steel portion at its periphery advantageously comprises a circular flange forming a cover rim, receiving the centering ledge on its lower rim and—by its shape—rigidifying the steel upper portion.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

The FIGURE is an elecation view, partially cut away, of the piston of the invention.

DETAILED DESCRIPTION OF THE PREFERRED EMBODIMENTS

An example embodiment of a piston according to the invention will be described below, with reference to the attached drawing representing schematically a partial cutaway of a piston of the invention, in which the piston head is constructed of a steel part 1 which—as a result of its high thermic resistance—raises the equilibrium temperature of the piston on compression surface fc to a higher level than it would have been if the compression surface were made of aluminum.

Constriction E prevents heat from flowing toward the periphery of part 1. Thus, friction surface sf remains relatively cool and, since part 1 has a low expansion coefficient (the expansion coefficient of steel being approximately half that of aluminum), the increase in the diameter of part 1 when hot remains small, thereby enabling construction of pistons having little play when cold.

Steel part 1 is centered in aluminum part 2 by circular fitting 4. Through the play of expansion differences, the contact between parts 1 and 2 at 4 can only improve as the temperature rises, thereby providing a seal against gas entry at 4. Moreover, the small amount of gas which should pass through said contact at 4 (with a great loss of charge entailing high pressure loss) is recovered in leaktight cavity 3. Said leaktight, concentric circular cavity 3, the essential component of the invention, opens at the upper portion of part 2 and extends down over the entire area of ring grooves 5, from the beds of which it is separated only by a relatively thin partition 6. Cavity 3 will advantageously have tapered walls to facilitate its casting. A concentric circular groove 7, provided in part 1 and inducing circular constriction E, covers and closes cavity 3.

The arrangement as represented in the drawing enables maximum resistance to the thermic flux between compression surface fc and the first groove of the firing ring. Said arrangement enables having and maintaining a maximal temperature gradient between the two zones, and, finally, for a given groove bed temperature on the order of 200°-220° C. (thus lower than ring gumming temperatures, which are around 230°-240° C.), it enables rapid attainment of the maximal temperature on compression surface fc, thus facilitating combustion while at the same time enabling reduction of cold play in the piston and of the noise which follows from it.

Heat is removed through steel plate 1, passing into aluminum 2 through the steel-aluminum interface, arriving in body 8 and finally transferred to the coolant through the cylinder wall.

Cavity 3 thus has the effect of protecting the entire ring assembly against heat which is present in aluminum 2 before it can be removed through body 8 as indicated above or through the washing of the crankcase oil under piston 2.

The level of thermal equilibrium may be regulated by:

(a) increasing or decreasing the thickness of the steel portion;

(b) reducing the steel-aluminum contact surface through which heat passes (the minimum surface is limited by the hardness of hot aluminum,). The support contact surfaces 9, located preferably in proximity to the axes 10 of the tightening screws 12, will be limited as a consequence.

Upper plate 1 comprises bossings 11 which lodge in corresponding cavities in part 2 and contain threaded screw holes for screws 12. Said threaded holes may pass completely through plate 1, with the ends of screws 12 being flush with surface fc where rapid carbon depositing during operation will assure their security.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A piston for an internal combustion engine, comprising:

a circular steel upper head element having an upper surface defining the entire piston face and a lower surface which are axially spaced to form a first thickness;

a circular light alloy lower skirt element having a radially outer surface, an upper surface covered by said lower surface of said upper element, said lower element including at least one first circumferential groove on the peripheral surface thereof;

means for securing said upper and lower elements to one another;

an annular U-shaped cavity defined in said upper surface of said lower element adjacent said peripheral surface, said cavity extending axially at least to a position closely adjacent said at least one first circumferential groove;

an annular U-shaped second groove defined in said lower surface of said upper element and facing said cavity to form a dead space, said second groove extending axially towards said upper surface of said upper element by a distance sufficient that the upper extremity of said second groove is separated from said upper surface of said upper element by less than said first thickness, wherein only said lower element includes at least one of said first grooves and wherein said upper and lower elements are centered only by contacting circumferential surfaces adjacent the peripheries of said upper and lower elements, said contacting circumferential surfaces acting to seal said dead space, further including:

at least one boss extending from said lower surface of said upper element in an area radially inward from said second groove;

at least one second cavity on said upper surface of said lower element, each said second cavity corresponding to one said at least one boss;

radially extending contact surfaces between said upper and lower elements, said radially extending contact surfaces consisting only of said at least one boss and corresponding cavity; and a threaded hole in said upper element at each said at least one boss, wherein said means for securing is engaged between at least one said second cavity and threaded hole.

2. The piston of claim 1 wherein each said threaded hole passes entirely through said upper element, and said means for securing comprises a screw in each said threaded hole, one end of each said screw being flush with said upper surface of said upper element.

3. The piston of claim 1 including a downwardly extending rim depending from the periphery of said upper element, wherein said contacting circumferential surfaces centering said upper and lower elements comprise the radially inner surface of said rim and the radially outer surface of said lower element.

* * * * *